US005622258A

United States Patent [19]

Baublitz et al.

[11] Patent Number: 5,622,258

[45] Date of Patent: Apr. 22, 1997

[54] INTERACTIVE PACKAGING SYSTEM

[76] Inventors: Leonard R. Baublitz, 5440 Lineboro East, Millers, Md. 21107; Ronnie L. Jones, 5620 Thom Rd., Mebane, N.C. 27302; Rodney D. Dixon, 1818 Woodhue Dr., Burlington, N.C. 27253

[21] Appl. No.: 617,536

[22] Filed: Mar. 15, 1996

Related U.S. Application Data

[63] Continuation of Ser. No. 236,492, Apr. 29, 1994, abandoned.

[51] Int. Cl.[6] ..... A45C 11/26

[52] U.S. Cl. ..... 206/349; 206/461; 206/779; 206/780

[58] Field of Search ..... 206/349, 461, 206/471, 493, 524.9, 779, 780

[56] References Cited

U.S. PATENT DOCUMENTS

| | | | |
|---|---|---|---|
| 901,695 | 10/1908 | Davis . | |
| 1,656,341 | 1/1928 | Smith . | |
| 1,806,149 | 5/1931 | Daugherty . | |
| 2,000,454 | 5/1935 | Peters . | |
| 2,321,473 | 6/1943 | Ferguson . | |
| 3,040,961 | 6/1962 | Meyers . | |
| 3,078,028 | 2/1963 | Skowronski . | |
| 3,089,632 | 5/1963 | Bartolucci . | |
| 3,481,453 | 12/1969 | Shreve, III et al. | 206/349 |
| 3,896,932 | 7/1975 | Giebel et al. | 206/493 |
| 4,109,786 | 8/1978 | Roccaforte et al. . | |
| 4,140,218 | 2/1979 | Forté . | |
| 4,165,805 | 8/1979 | Fethke et al. | 206/461 |
| 4,179,029 | 12/1979 | Fethke et al. | 206/349 |
| 4,315,569 | 2/1982 | Jaeschke . | |
| 4,401,255 | 8/1983 | Conroy et al. . | |
| 4,561,542 | 12/1985 | Przepiora et al. . | |
| 4,662,512 | 5/1987 | Durand . | |
| 4,872,551 | 10/1989 | Theros | 206/349 |
| 5,011,070 | 4/1991 | Plunkett . | |
| 5,279,417 | 1/1994 | Seaton | 206/349 |
| 5,332,085 | 7/1994 | Fraser | 206/779 |
| 5,348,145 | 9/1994 | Steinfels, III | 206/779 |

FOREIGN PATENT DOCUMENTS

| | | | |
|---|---|---|---|
| 2215298 | 9/1989 | United Kingdom | 206/461 |

*Primary Examiner*—David T. Fidei
*Attorney, Agent, or Firm*—Harness, Dickey & Pierce, P.L.C.

[57] ABSTRACT

An interactive packaging system is disclosed which is designed to securely support therein a product yet enable a potential purchaser thereof direct visual and tactile access to the product without the need to open the packaging. Additionally, the package includes a compartment and associated retention arrangement within which supplemental package of supplies or the like may be positioned.

20 Claims, 2 Drawing Sheets

INTERACTIVE PACKAGING SYSTEM

This is a continuation of U.S. patent application Ser. No. 08/236,492 filed Apr. 29, 1994 now abandoned.

BACKGROUND AND SUMMARY OF THE INVENTION

The present invention relates generally to packaging containers for manufactured goods and more specifically to interactive packing systems which afford a potential purchaser both visual and tactile access to the product contained therein.

There are many considerations that must be taken into account when developing packaging for products for retail sale. Such factors include the need to attract the potential buyer's attention, the ability for the store owner to be able to conveniently display the product, the need to contain and protect the product to name but a few. In addition to these considerations with certain types of products such as hand tools for example, it is very desirable to design packaging that will enable the potential purchaser to handle the product to obtain both tactile as well as a visual "feel" for the product. Such packaging, commonly referred to as interactive packaging is also desirable because it allows a closer examination of the product prior to purchase without the need for the potential consumer to open and possibly damage the packaging to conduct his examination.

The present invention provides a unique and highly effective solution to the above noted and often conflicting objectives by providing a packaging system which maximizes purchaser interaction with the product while also securely protecting and supporting the product therein so as to avoid potential damage during transporting of same. Further, because the product is fully contained within the confines of the package itself, quantities may be easily packed in larger containers for shipping without concern for damage to or loss of included parts or accessories.

Additional advantages and features of the present invention will become apparent from the subsequent description and the appended claims taken in conjunction with the accompanying drawings.

DESCRIPTION OF THE PREFERRED EMBODIMENTS

Figure 1:
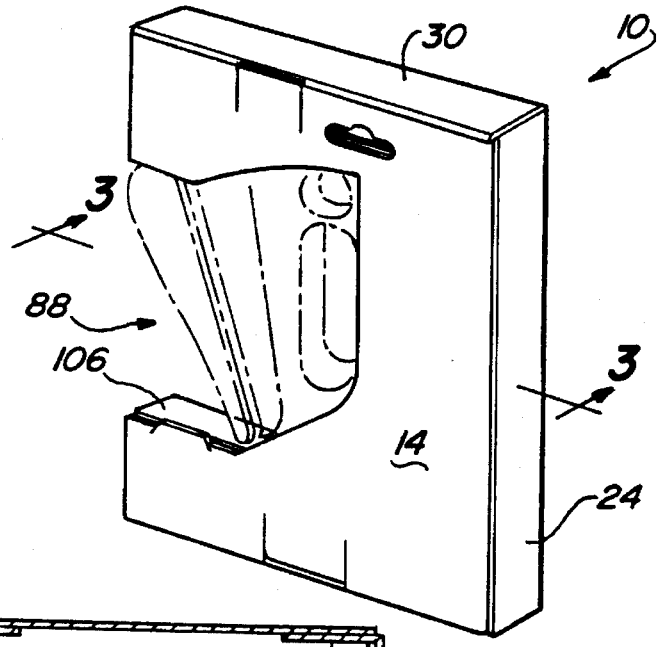
FIG. 1 is a perspective view of the packaging system in accordance with the present invention.

Referring now to FIG. 1, there is shown a packaging system in accordance with the present invention indicated generally at 10. As shown herein, packaging system 10 is specifically designed for use in connection with a manually operated staple gun and affords a potential purchaser thereof both visual and tactile contact with the product including not only the ability to grasp the staple gun but also the ability to operate same without the need to open or remove any portion of the product itself.

Figure 2:
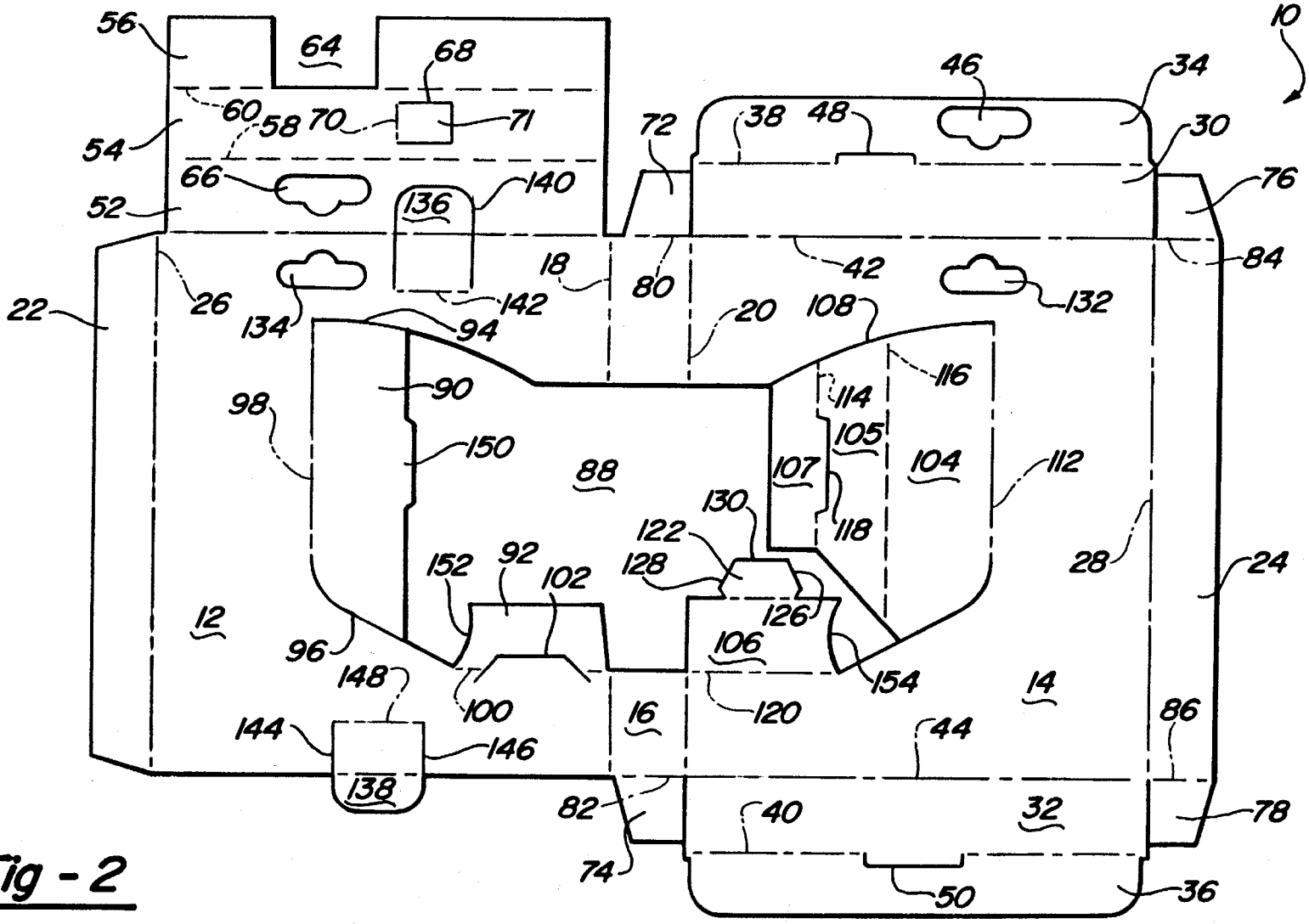
FIG. 2 is a developed view of the packaging system of FIG. 1.

As best seen with reference to FIG. 2, packaging system 10 is preferably formed from a single sheet of suitable paperboard material such as a three-ply material having a paper corrugated member sandwiched between two paper layers of a desired weight and strength suitable for the product to be contained therein.

Packaging system 10 includes front and back panel portions 12, 14 and a sidewall panel portion 16 disposed therebetween with suitable fold lines 18, 20 formed to separate the respective panel portions. Integral with the opposite outer edges of the front and back panel portions 12 and 14 are a pair of sidewall panel portions 22, 24 which are coextensive therewith which are designed to be folded into overlapping relationship and secured together by means of a suitable adhesive or other suitable securing means to thereby form a second sidewall. Suitable fold lines 26, 28 are also provided at the juncture of panel portions 22, 24 and corresponding panels 12, 14.

Back panel 14 also has upper and lower end closure members each comprising an end panel 30, 32 respectively and a flap 34, 36 respectively with fold lines 38 and 40 formed therebetween and fold lines 42 and 44 formed at their respective juncture with back panel 14. Flap 34 has a hang hole cutout 46 provided therein shifted slightly from center and a generally "U" shaped cut line 48 formed along fold line 38 and shifted slightly in the opposite direction from the center of flap 34. Similarly, the lower end closure means includes a generally "U" shaped cut line 50 formed approximately midway along fold line 40.

The upper end of front panel 12 also includes a flap assembly which includes first, second and third panels 52, 54, 56 respectively with perforation lines 58 and 60 therebetween and fold line 62 lying between panel 52 and front panel 12. Panel 56 includes a cutout notched section 64 intermediate the end thereof whereas panel 52 includes a cutout hang hole 66. Panel 54 may also include an optionally generally "U" shaped cut line 68 with a fold line 70 extending between the open legs thereof which defines a fold-up tab 71.

Sidewall panel portion 16 and end flap 24 each include respective tab portions 72, 74, 76, 78 extending from opposite ends thereof and corresponding fold lines 80, 82, 84, 86 at the juncture with respective panel portions 16 and 24.

An irregularly shaped cutout portion 88 is also provided which spans front panel 12, side panel portion 16 and back panel 14. Cutout portion 88 is designed to afford access to the product contained within the packaging system and is generally centered and symmetrical about a midline of sidewall panel portion 16. A pair of panel segments or tabs 90 and 92 project into cutout portion 88 from front panel, tab 90 being defined by upper and lower cut lines 94, 96 and fold line 98. Tab 92 is defined by fold line 100 which also includes a cut line 102 positioned therealong, the opposite legs of which extend in a diverging pattern with respect to each other.

A pair of panel segments or tab portions 104 and 106 also extend into cutout portion 88 from back panel 14 with tab 104 being defined by upper and lower cut lines 108, 110 and fold line 112. Tab 104 is separated into three portions by fold line 114 and perforation line 116. A cut line 118 is also provided along fold line 114.

Tab portion 106 is defined by fold line 120 and includes a tongue 122 defined in part by a further fold line 124. The opposite lateral edges 126, 128 of tongue 122 extend outwardly from fold line 124 in diverging relationship a short distance and then in converging relationship to an outer laterally extending edge 130.

In addition to cutout 88, back panel 14 also includes a hang hole cutout 132 positioned adjacent fold line 42 and slightly offset from the center midline thereof.

Front panel 12 also includes a hang hole cutout 134 positioned adjacent fold line 62 and slightly offset from the midline thereof. Additionally, front panel 12 includes a pair of locking tabs 136 and 138. Locking tab 136 is defined by a generally U-shaped cut line 140 and fold line 142 positioned adjacent hang hole cutout 134. The base of generally U-shaped cut line 140 extends into panel 52. Locking tab 138 projects outwardly from the lower edge of front panel 12 and is defined by a pair of generally parallel cut lines 144, 146 and fold line 148.

As noted above, packaging system 10 will preferably be formed from a single sheet of suitable paperboard material and is well suited for the blank as described above and shown in FIG. 2 to be cut by any suitable means such as a steel rule die, although other suitable means for cutting the sheets to the desired configuration may also be utilized.

Once cut, the blank may be initially formed into an open ended box of rectangular shape by folding the respective panels and flaps 24, 14, 16, 12 and 22 about respective fold lines 28, 20, 18 and 26. As noted above, flaps 22 and 24 will be positioned in overlapping relationship and may be bonded or secured together by any suitable means such as a suitable adhesive. Thereafter, the lower end may be closed by initially folding tabs 74 and 78 inwardly and then moving flap 36 into abutting relationship with the inner surface of front panel 12 which will move panel 32 into overlying relationship with the open lower end of packaging system 10. In order to prevent inadvertent opening of the lower end closure means, locking tab 138 is then inserted into the opening provided by cut line 50.

Figure 3:
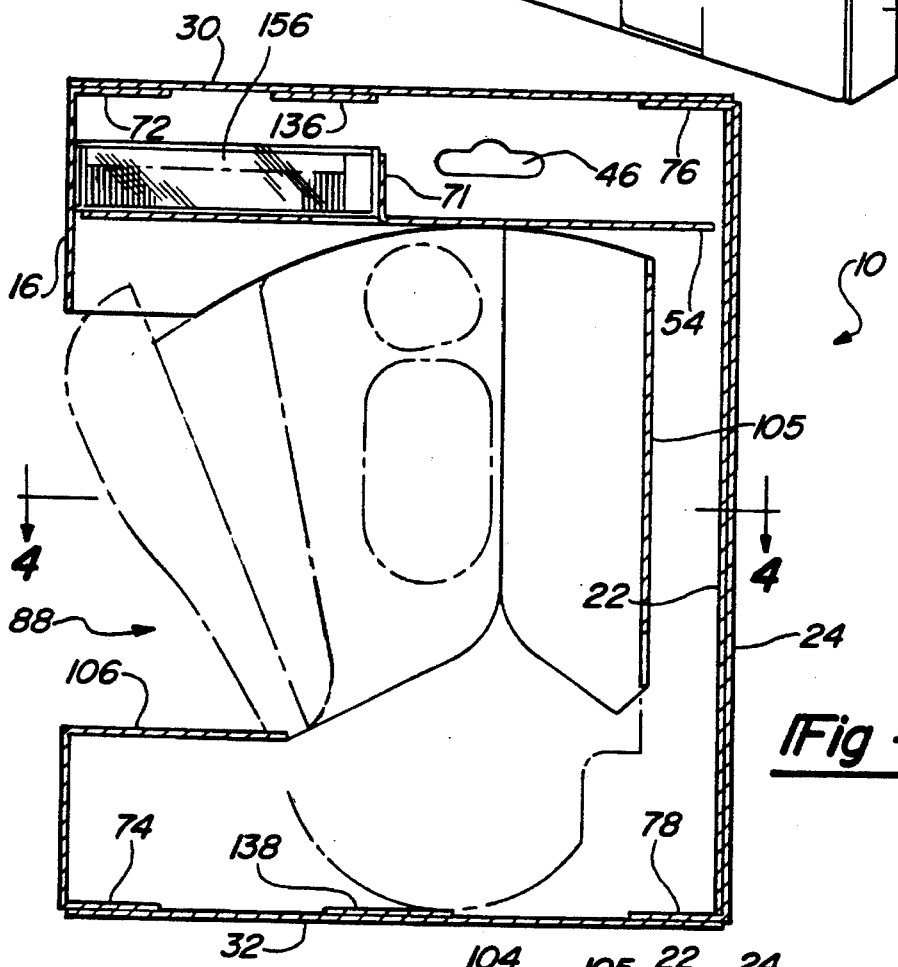
FIG. 3 is a section view of the packaging system of FIG. 1, the section being taken along line 3—3 thereof.
Figure 4:
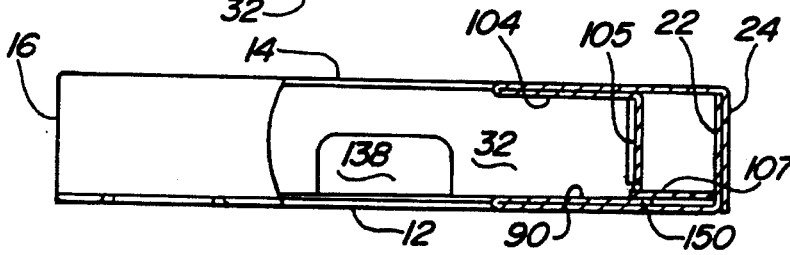
FIG. 4 is also a section view of the packaging system of FIG. 1, the section being taken along line 4—4 of FIG. 3.

Next, panel 104 is folded inwardly back against the inner surface of back panel 14, portion 105 is positioned so as to span the distance between the inner surfaces of front panel 12 and back panel 14 and portion 107 is folded so as to extend towards and rest against the sidewall formed by overlapping portions 22 and 24 as best seen with reference to FIG. 4. In this position, portion 105 forms a platform which is adapted to provide support for the staple gun as shown in FIG. 3. In order to retain portions 104, 105 and 107 in the desired position, portion 90 is folded back against the inner surface of front panel 12 and a projection 150 provided thereon is received in the opening provided by cut line 118. The space below portion 105 may be used to accommodate an instruction manual, warranty cards or other such information or accessories if desired. At this point the packaging system 10 is now ready to receive the staple gun which may be easily slid in from the open upper end thereof to the point where the heel or back end of the staple gun rests against the bottom end closure of panel 32 and the base or foot of the staple gun is supported by the platform defined by portion 105.

The flap assembly extending from the top of front panel 12 which includes panels 52, 54 and 56 may now be folded into the interior of packaging system 10 by folding the three panels into a generally U-shaped arrangement and then folding panel 52 inwardly so that it abuts the upper inner surface of front panel 12. Once folded, panel 56 will abut the inner surface of back panel 14 with panel 54 spanning the distance between these two facing inner surfaces shown in FIG. 3, panels 52 and 56 will be of sufficient width so as to position panel 54 in abutting relationship with the front of the staple gun again as best seen with reference to FIG. 3.

At this point, it should be noted that the staple gun is securely supported on three sides by respective panels 54, 105 and 32. While, as shown, both the front and back surfaces of the staple gun shown in phantom in FIG. 3 are arcuate, they have different radii of curvature such that the points contacted by panels 32 and 54 represent the shortest dimension between these surfaces. Thus these two panels cooperate to resist any pivotal movement of the staple gun within packaging system 10. Additionally, it should be noted that cutout 88 is sized in the area that it crosses side panel 16 such that the upper portion thereof overhangs a forward portion of the actuating handle of the staple gun to further assist in restricting movement of the staple gun outwardly through cutout portion 88.

Packaging system 10 also incorporates a space defined by panels 52, 54, 56 and the inner surface of sidewall 16 within which a container 156 having a supply of staples for use in the staple gun may be provided as shown in FIG. 3. In order to prevent lateral movement of such container, tab 71 may be folded upwardly to restrict movement thereof and thus also prevent the container from obstructing the hang hole.

The upper end of container assembly 10 may now be closed by moving panel 34 into overlying relationship with the inwardly facing surface of panel 52 after which locking tab 136 may be moved into the opening provided by cut line 48 to thereby lock the upper end in a closed position. It should be noted that the upper edge of panel 56 abuts the inner surface of panel 30 adjacent fold line 42 thus aiding in retaining panel 54 in abutting relationship with the front end of the staple gun.

Lastly, in order to further restrict possible movement of the staple gun within packaging system 10 as well as to improve the aesthetic appearance thereof, flap 92 is first folded inwardly and flap 106 then folded over on top thereof with locking tab 122 being received in the opening provided by cut line 102. The size of the opening defined by cut line 102 relative to the size of tab 122 is such that the diverging portions of sidewalls 128 will cooperate with the edges of the opening to retain flaps 92 and 106 in a closed position. As shown in FIG. 2, edges 152 and 154 of respective flaps 92 and 106 which will face the interior of packaging system 10 when in a closed position are contoured to generally correspond with the shape of the staple gun at the point of contact therewith. This feature coupled with the provision of two thicknesses of the material from which packaging system 10 is formed cooperate to securely retain the lower portion of the staple gun within the confines of the thus formed package.

It should be noted that cutout 88 is formed of a size and shape as to afford substantially full access to the actuating handle of the staple gun as well as access to the finger holes provided on the body of the staple gun. This feature not only enables the potential purchaser an unobstructed view of a significant portion of the staple gun but also enables the potential purchaser to grasp the staple gun and even depress the actuating handle thus enabling the potential purchaser to experience the "feel" of the staple gun as it is to be used without the need to open and/or remove the staple gun from its packaging system. It should also be noted that hang holes 132, 134, 66 and 46 and cutout 64 will be positioned in aligned relationship with respect to each other and also such that the center of gravity of the packaging system 10 with the staple gun and any accessory materials contained therein will lie along a line passing through the center of the hang holes and extending parallel to sidewall 16 so as to ensure the resulting product will hang in a level manner at the point of sale display.

As used herein, the term "fold line" is intended to refer to a line about which respective panels or the like may be folded when assembling the packaging system. Such fold lines may be formed by crushing the corrugated paperboard along the intended fold line or in any other suitable manner to facilitate this objective. Likewise, the term "cut line" as used herein refers to a full penetration cut of the material and the term "perforation line" refers to a series of spaced apart full thickness cuts in the material. The specific arrangement of fold lines and perforation lines shown in the above described embodiment eliminate the need to perform crushing operations on both sides of the panel but rather enable all lines about which panels are to be folded to be formed from one side of the panel.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

We claim:

1. An interactive packaging system for a product comprising:

a front panel defining a first plane;

a back panel positioned in spaced parallel relationship with said front panel and defining a second plane;

first and second side panels extending between and at ends thereof interconnecting said front and back panels, said first and second side panels defining third and fourth planes intersecting said first and second planes;

first and second end closure means for closing opposite ends of said packaging system, said first and second end closure means defining fifth and sixth planes each of which intersects said first, second, third and fourth planes to define an encompassed volume;

a cutout portion extending across a portion of said front panel, back panel and across one of said first and second side panels intermediate the ends thereof, said cutout portion affording access to said product contained within said packaging system; and means for supporting and retaining said product within said encompassed volume, said means for supporting and retaining said product coupled with either or both said front and back panels, such that said product is prohibited from removal through said cutout portion.

2. A packaging system as set forth in claim 1 wherein said cutout portion is adapted to enable handling of said product by a potential purchaser.

3. A packaging system as set forth in claim 2 wherein said cutout portion is symmetrical about a midline of said one of said first and second side panels.

4. A packaging system as set forth in claim 1 wherein said supporting and retaining means include means defining a substantially enclosed space within said encompassed volume.

5. A packaging system as set forth in claim 4 wherein said enclosed space is adapted to accommodate an accessory item associated with said product.

6. An interactive packaging system for a product comprising:

a front panel defining a first plane;

a back panel positioned in spaced parallel relationship with said front panel and defining a second plane;

first and second side panels extending between and interconnecting said front and back panels, said first and second side panels defining third and fourth planes intersecting said first and second planes;

first and second end closure means for closing opposite ends of said packaging system, said first and second end closure means defining fifth and sixth planes each of which intersects said first, second, third and fourth planes to define an encompassed volume;

a cutout portion extending across a portion of said front panel, back panel and across one of said first and second side panels, said cutout portion affording access to said product contained within said packaging system; and means for supporting and retaining said product within said encompassed volume, said supporting and retaining means including means defining a substantially enclosed space within said encompassed volume, said means for supporting and retaining said product coupled with either or both said front and back panels; and a retention member projecting into said enclosed space, said retention member being adapted to retain an accessory item in a predetermined position therein.

7. A packaging system as set forth in claim 1 wherein said packaging system is formed from a single sheet of material.

8. A packaging system as set forth in claim 7 wherein said front panel, said back panel, said first and second side panels, said first and second end closure means and said supporting means are integrally formed from said single sheet.

9. A packaging system as set forth in claim 1 wherein said single sheet of material is a multi-ply paperboard material.

10. An interactive packaging system for a product comprising:

a front panel defining a first plane;

a back panel positioned in spaced parallel relationship with said front panel and defining a second plane;

first and second side panels extending between and interconnecting said front and back panels, said first and second side panels defining third and fourth planes intersecting said first and second planes;

first and second end closure means for closing opposite ends of said packaging system, said first and second end closure means defining fifth and sixth planes each of which intersects said first, second, third and fourth planes to define an encompassed volume;

a cutout portion extending across a portion of said front panel, back panel and across one of said first and second side panels, said cutout portion affording access to said product contained within said packaging system; and means for supporting and retaining said product within said encompassed volume, said supporting and retaining means including a first flap integrally formed with said front panel;

a second flap integrally formed with said back panel;

one of said first and second flaps including a tab and the other including a cut line defining an opening, said flaps being folded into overlapping relationship with said tab being received within said opening to retain said flaps in said folded position, each of said flaps including an edge portion adapted to abut a portion of said product to thereby aid in retaining said product in position.

11. An interactive packaging system for a product comprising:

a front panel defining a first plane;

a back panel positioned in spaced parallel relationship with said front panel and defining a second plane;

first and second side panels extending between and interconnecting said front and back panels, said first and second side panels defining third and fourth planes intersecting said first and second planes;

first and second end closure means for closing opposite ends of said packaging system, said first and second end closure means defining fifth and sixth planes each of which intersects said first, second, third and fourth planes to define an encompassed volume;

a cutout portion extending across a portion of said front panel, back panel and across one of said first and second side panels, said cutout portion affording access to said product contained within said packaging system; and means for supporting and retaining said product within said encompassed volume, said supporting and retaining means including a first panel integrally formed with one of said front and back panels, second, third and fourth panels integrally formed with the other of said front and back panels, said second panel being folded against an inner surface of said other panel, said third panel being folded so as to extend between said inner surface of said other panel and an inner surface of said one panel to thereby define a support surface for said product, said fourth panel being folded so as to extend along the inner surface of said one panel toward one of said first and second side panels, said first panel being folded against an inner surface of said one panel and interengaging means formed on said first panel and at a fold line between said third and fourth panel to retain said first, second, third and fourth panels in said folded position.

12. A packaging system as set forth in claim 11 wherein said first, second, third and fourth panels project into the area of said cutout portion prior to being moved into said folded position.

13. An interactive packaging system for a product comprising:

a front panel defining a first plane;

a back panel positioned in spaced parallel relationship with said front panel and defining a second plane;

first and second side panels extending between and interconnecting said front and back panels, said first and second side panels defining third and fourth planes intersecting said first and second planes;

first and second end closure means for closing opposite ends of said packaging system, said first and second end closure means defining fifth and sixth planes each of which intersects said first, second, third and fourth planes to define an encompassed volume;

a cutout portion extending across a portion of said front panel, back panel and across one of said first and second side panels, said cutout portion affording access to said product contained within said packaging system; and means for supporting and retaining said product within said encompassed volume, said supporting and retaining means including first, second and third panels integrally formed with one of said front and back panels, said first panel being folded against an inner surface of said one panel, said second panel being folded so as to extend between the inner surfaces of said one panel and the other of said front and back panels, and said third panel being folded to extend along the inner surface of said other panel, said second panel being positioned in abutting relationship with said product and retained in said position by the engagement of said third panel with one of said first and second end closure means.

14. A sheet member adapted to be formed into a packaging system for a product, said sheet member including:

a first portion adapted to form a front panel;

a second portion adjoining said first portion and adapted to form a first sidewall;

a third portion adjoining said second portion and adapted to form a back panel;

a fourth portion adjoining said third portion;

a fifth portion adjoining said first portion and adapted to cooperate with said fourth portion to define a second sidewall;

a sixth portion adjoining one of said first and third portions and adapted to form a first end closure;

a seventh portion adjoining said one or the other of said first and third portions and adapted to form a second end closure;

a cutout portion extending across said first, second and third portions and adapted to define an opening to afford visual and tactile contact with said product;

an eighth portion adjoining said first portion at the periphery of said cutout portion formed in said first portion;

a ninth portion adjoining said third portion at the periphery of said cutout portion formed in said third portion;

said eighth and ninth portions being adapted to form a first support for said product;

a tenth portion adjoining said first portion at the periphery of said cutout portion in said first portion;

an eleventh portion adjoining said third portion at the periphery of said cutout portion in said third portion;

said tenth and eleventh portions being adapted to cooperate to provide a closure means for a portion of said cutout portion and to retain said product in said packaging system; and a twelfth portion adjoining said first portion and adapted to form a second support for said product;

fold lines provided at each location where one of said first three twelfth portions adjoins a respective other of said first three twelfth portions to facilitate formation of said sheet material into said packaging system.

15. A sheet member as set forth in claim 14 wherein one of said eighth and ninth portions includes means dividing said one portion into first, second and third integrally formed sections, said first section being adapted to be folded against an inner surface of one of said first and third portions which said one portion adjoins, said second section being adapted to extend between inner surfaces of said first and third portions and said third section being folded against the other of said first and third portions to thereby form a supporting platform for said product.

16. A packaging system as set forth in claim 10 wherein said supporting means further includes means defining a substantially enclosed space within said encompassed volume adapted to accommodate an accessory item for said product.

17. A packaging system as set forth in claim 16 further comprising a retention member projecting into said enclosed space, said retention member being adapted to retain said accessory item in a predetermined position in said enclosed space.

18. A packaging system as set forth in claim 11 wherein said supporting means further includes means defining a substantially enclosed space within said encompassed volume adapted to accommodate an accessory item for said product.

19. A packaging system as set forth in claim 18 further comprising a retention member projecting into said enclosed space, said retention member being adapted to retain said accessory item in a predetermined position in said enclosed space.

20. A packaging system as set forth in claim 13 wherein said supporting means further includes means defining a substantially enclosed space within said encompassed volume adapted to accommodate an accessory item for said product.

* * * * *

UNITED STATES PATENT AND TRADEMARK OFFICE

CERTIFICATE OF CORRECTION

PATENT NO. : 5,622,258

DATED : April 22, 1997

INVENTOR(S) : Leonard R. Baublitz et al.

It is certified that error appears in the above-indentified patent and that said Letters Patent is hereby corrected as shown below:

Column 8, line 43, claim 14,
"three" should be --through--.

Column 8, line 44, claim 14,
"three" should be --through--.

Signed and Sealed this

Second Day of September, 1997

*Attest:*

*Attesting Officer*

BRUCE LEHMAN

*Commissioner of Patents and Trademarks*